US005768991A

United States Patent [19]

Cless et al.

[11] Patent Number: 5,768,991

[45] Date of Patent: Jun. 23, 1998

[54] LABEL PRINTER FOR PRINTING MOISTENED ADHESIVE BAR CODE LABELS

[75] Inventors: Gerhard Cless, Northbrook; Kenneth Folke Ullenius, Cary; Michael Roger Garross, Beach Park; Gene Allen Hofer, Lake Zurich; Gary N. Schneider, Libertyville; Barry Matthew Bidinger, Palatine, all of Ill.

[73] Assignee: Zebra Technologies Corporation, Vernon Hills, Ill.

[21] Appl. No.: 631,322

[22] Filed: Apr. 10, 1996

[51] Int. Cl.[6] ..... B41F 13/56

[52] U.S. Cl. ..... 101/227; 118/41; 118/268; 118/325; 400/621

[58] Field of Search ..... 101/227, 216, 101/348; 118/35, 37, 39–42, 46, 268, 325; 400/621

[56] References Cited

U.S. PATENT DOCUMENTS

| | | | |
|---|---|---|---|
| 830,400 | 9/1906 | Zellén | 118/268 |
| 868,977 | 10/1907 | Elliott | 118/42 |
| 1,726,089 | 8/1929 | Uttz, Sr. . | |
| 1,860,668 | 5/1932 | Gillet | 118/42 |
| 1,921,626 | 8/1933 | Link . | |
| 2,138,474 | 11/1938 | Gautier . | |
| 2,294,670 | 9/1942 | Krueger | 118/268 |
| 2,352,149 | 6/1944 | Gautier . | |
| 2,362,755 | 11/1944 | Krueger . | |
| 2,506,673 | 5/1950 | Krueger . | |
| 2,565,451 | 8/1951 | Hoitt . | |
| 2,614,523 | 10/1952 | Havemann et al. | 118/39 |
| 2,757,730 | 8/1956 | Hempel | 118/41 |
| 2,861,539 | 11/1958 | Bergmark | 118/41 |
| 2,970,536 | 2/1961 | Bach | 101/227 |
| 3,037,477 | 6/1962 | Krueger et al. . | |
| 3,208,428 | 9/1965 | Doyle | 118/41 |
| 4,121,536 | 10/1978 | Chamberlain et al. . | |
| 4,380,210 | 4/1983 | Auerbach . | |
| 4,386,576 | 6/1983 | Johnson . | |
| 4,538,541 | 9/1985 | Zimmer . | |
| 4,707,211 | 11/1987 | Shibata | 347/172 |
| 5,188,271 | 2/1993 | Dannatt | 226/102 |
| 5,392,704 | 2/1995 | Silverberg et al. | 400/621 |
| 5,415,484 | 5/1995 | Gallagher et al. | 400/621 |
| 5,569,327 | 10/1996 | Paradis et al. | 118/268 X |

*Primary Examiner*—Eugene H. Eickholt
*Attorney, Agent, or Firm*—Trexler, Bushnell, Giangiorgi & Blackstone, Ltd.

[57] ABSTRACT

A novel printer is used to print and produce a pre-moistened label and the like on demand by an operator. The printer includes an outer casing; a media associated with the casing, and a printhead mounted in the casing for printing indicia and the like on an upper surface of the media. The media has a liquid activated adhesive on a lower surface thereof. A liquid delivery structure and a liquid application structure are associated with the casing and may be provided a separate modules which are attached to an existing printer. The liquid delivery structure supplies liquid to the liquid application structure and the liquid application structure applies the liquid to the adhesive coated lower surface of the media to pre-moisten the media before it is dispensed from the printer. The printhead prints the indicia and the like on the media prior to the stage where the adhesive coating on the media is moistened by the liquid application structure. A cutter is provided for severing the media to produce an individual label or the like. The cutter cuts the media prior to the application of liquid thereto by the liquid application structure. A demand button associated with the printer apparatus is provided for activating the printer so that it produces a label. When the demand button is depressed by an operator, the printer prints, cuts and wets the media to produce the individual label.

19 Claims, 2 Drawing Sheets

FIG. 1
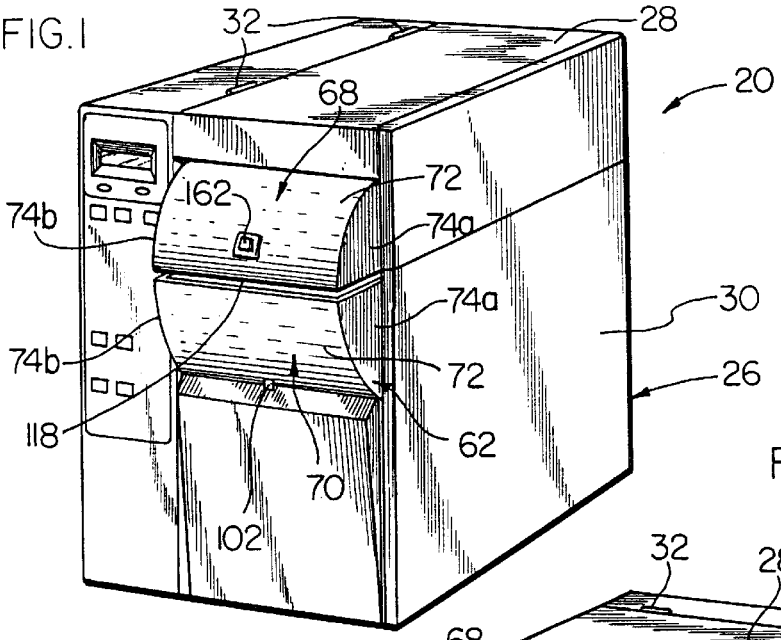
FIG. 2
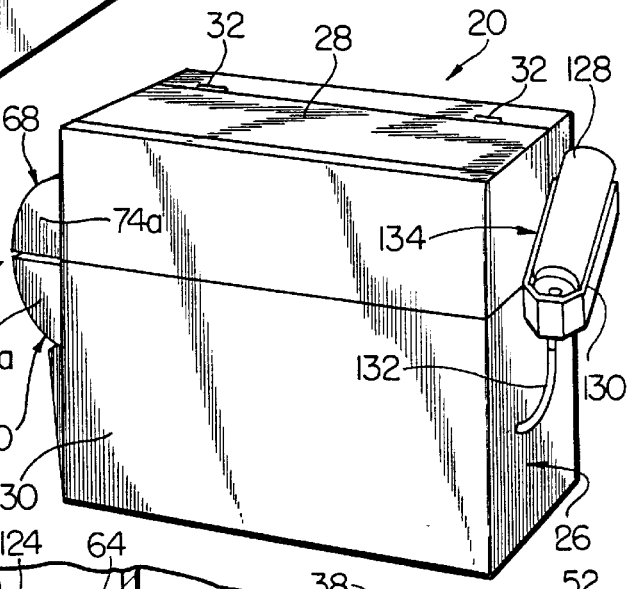
FIG. 5
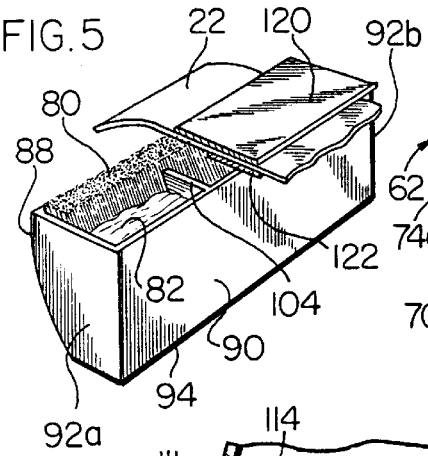
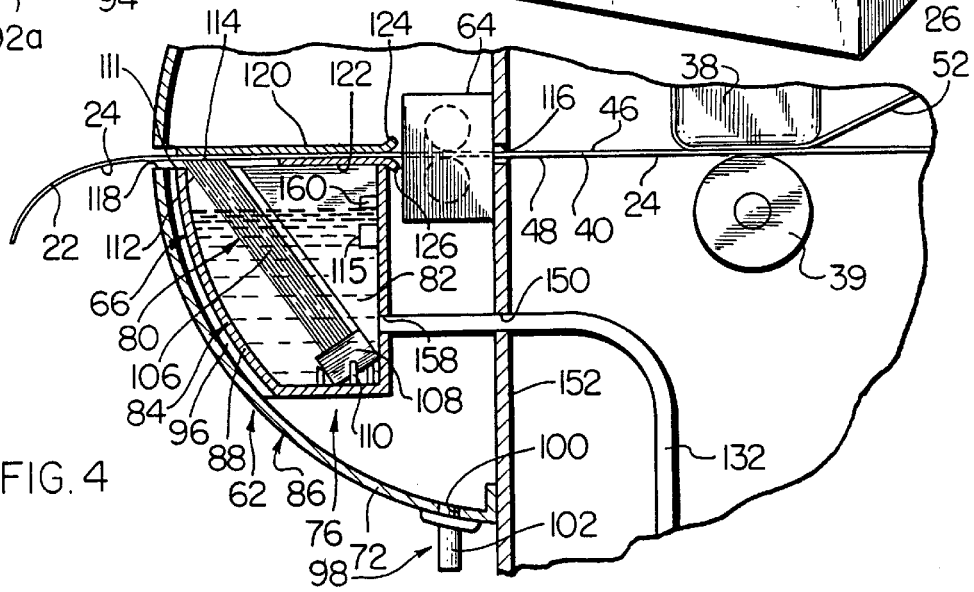
FIG. 4

LABEL PRINTER FOR PRINTING MOISTENED ADHESIVE BAR CODE LABELS

BACKGROUND OF THE INVENTION

This invention is generally directed to a printer which is used to print pre-moistened bar code labels and the like. More particularly, the invention contemplates a printer which prints pre-moistened labels and the like on demand, and which can be taken directly from the printer and adhered to an item to be labeled.

Prior art printers print labels which are formed of a media which is releasably attached to release paper. Indicia, such as a bar code, is printed on the top surface of the media and the bottom surface of the media has an adhesive material which releasably adheres the media to the release paper. The adhesive material is releasable from the release paper, but once the label is adhered to the item to be labeled, the label cannot easily be removed.

To adhere the label to the item to be labeled, the media, which has the indicia printed thereon by the printer, is peeled off of or released from the release paper. Thereafter, the adhesive on the back of the media is used to secure the label on the item.

The use of release paper increases the cost of the label because of the extra piece. In addition, the use of release paper produces unneeded waste materials.

Other labels eliminate the use of a release paper and, instead, are supplied with a dry adhesive material on the back surface of the media. To adhere the label to the item to be labeled, the dry adhesive on the back of the media is moistened by using a sponge. Thereafter, the wet adhesive on the back of the media is used to secure the label on the item.

While this type of label eliminates the excess waste material which results from the label that employs the release paper, it is often inconvenient and time consuming to moisten the back of the label. Also, the operator must ensure that the back of the label is completely moistened so that the label will not have an upturned corner which could result in part or all of the label detaching from the item.

The present invention is intended to present a novel solution to the above-identified problems or deficiencies in the prior art. In addition, the present invention presents several other advantages and features which will become apparent upon a reading of the attached specification.

OBJECTS AND SUMMARY OF THE INVENTION

A general object of the present invention is to provide a novel printer for printing pre-moistened bar code labels and the like.

An object of the present invention is to provide a novel printer which prints pre-moistened labels and the like on demand, and which can be taken directly from the printer and adhered to an item to be labeled.

Briefly, and in accordance with the foregoing, the present invention discloses a novel printer apparatus for printing and forming a pre-moistened label and the like on demand by an operator. The moistened label can be taken directly from the printer apparatus and adhered to the item to be labeled.

The printer includes an outer casing; a media associated with the casing, and a printhead mounted in the casing for printing indicia, images and the like on an upper surface of the media. The media has a liquid activated adhesive on a lower surface thereof.

A liquid delivery structure and a liquid application structure are associated with the casing and may be provided as separate modules which are attached to an existing printer. The liquid delivery structure supplies liquid to the liquid application structure and the liquid application structure applies the liquid to the adhesive coated lower surface of the media to pre-moisten the media before it is taken from the printer. The printhead prints the indicia, image or the like on the media prior to the stage where the adhesive coating on the media is moistened by the liquid application structure.

A cutter is provided for severing the media to produce an individual label. The cutter cuts the media prior to the application of liquid thereto by the liquid application structure.

A demand button is provided on a front panel of the module which houses the liquid application structure. When the demand button is depressed by an operator, the printer prints, cuts and wets the media to produce the individual label. The demand button is connected to suitable electronics which operate the printer apparatus.

Top and bottom elongated guide plates are provided for guiding the media over the liquid application structure. The media passes between the elongated guide plates which extend from the cutter to the liquid application structure. The top guide plate forces the media in contact with the liquid application structure. In addition, the guide plates hold a portion of the moistened label in the printer apparatus until the operator takes the moistened label from the printer apparatus.

In a preferred embodiment, the liquid application structure is a brush which has a plurality of individual bristles which are in contact with the media as it passes thereover. The brush is mounted in a reservoir which holds the liquid therein and the brush transports the liquid to the underside of the media to moisten the adhesive coating thereon by a capillary action. The brush is positioned within the reservoir such that said bristles are offset from a vertical axis approximately 45°. The tops of the individual brush bristles are cut at an angle, approximately 45°, so as to allow the media to glide over the bristles. The brush is removably mounted in the reservoir by a mounting structure.

The reservoir in which the brush is mounted is preferably formed of an inner wall and an outer wall. The inner wall is spaced from the outer wall and has the brush mounted therein. The inner wall holds the supply of liquid therein. The outer wall retains any spillage of liquid from the inner wall in the event the printer apparatus is tipped. The inner wall may include baffles to minimize sloshing of the liquid therein. An overflow drain is connected to the outer wall for venting any liquid collected therein to the exterior of the printer apparatus. A heater is provided in the water or on the brush to improve the wetting and set-up time of the adhesive on the underside of the media.

The liquid delivery structure includes a containing structure for holding liquid therein. A tube connects the containing structure to the inner wall of the reservoir.

The containing structure is mounted in a feeder which is connected to the casing. In the preferred embodiment, the containing structure is a bottle which is removably mounted in the feeder such that the bottle can be removed from the feeder and replaced by a full bottle or refilled with liquid when the liquid supply in the bottle is exhausted.

The outlet of the bottle is at a same level as the desired liquid level in the reservoir such that said liquid is supplied to the reservoir from the bottle by gravity feed. A liquid level sensor is mounted in one of the bottle, the reservoir or along the length of tubing for sensing the level of liquid in the system.

To print the label, the following steps are performed: The demand button is depressed by the operator which signals the printer apparatus to print and form the label. The media passes under the printhead and the printhead prints preselected indicia on the media. The cutter severs the printed-on media so as to form the individual label. The guide plates guide the label over the liquid application structure which wets or moistens the liquid activated adhesive on the underside of the individual label. Thereafter, the wetted label is held by the guide plates until the operator takes the moistened label from the printer apparatus.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which:

FIG. 1 is a front perspective view of a printer apparatus which incorporates the features of the present invention;

FIG. 2 is a rear perspective view of a printer apparatus which incorporates the features of the present invention showing a rearward module before it is attached to the printer apparatus;

FIG. 4 is an enlarged, schematic, side elevational view of a portion of the interior of the printer apparatus shown in FIG. 3 in accordance with the present invention; and FIG. 5 is a perspective view of a portion of a reservoir having a moistening brush mounted therein and showing a portion of a pair of guide plates which are used to guide a printed label over the moistening brush.

DETAILED DESCRIPTION OF A PREFERRED EMBODIMENT

Figure 3:
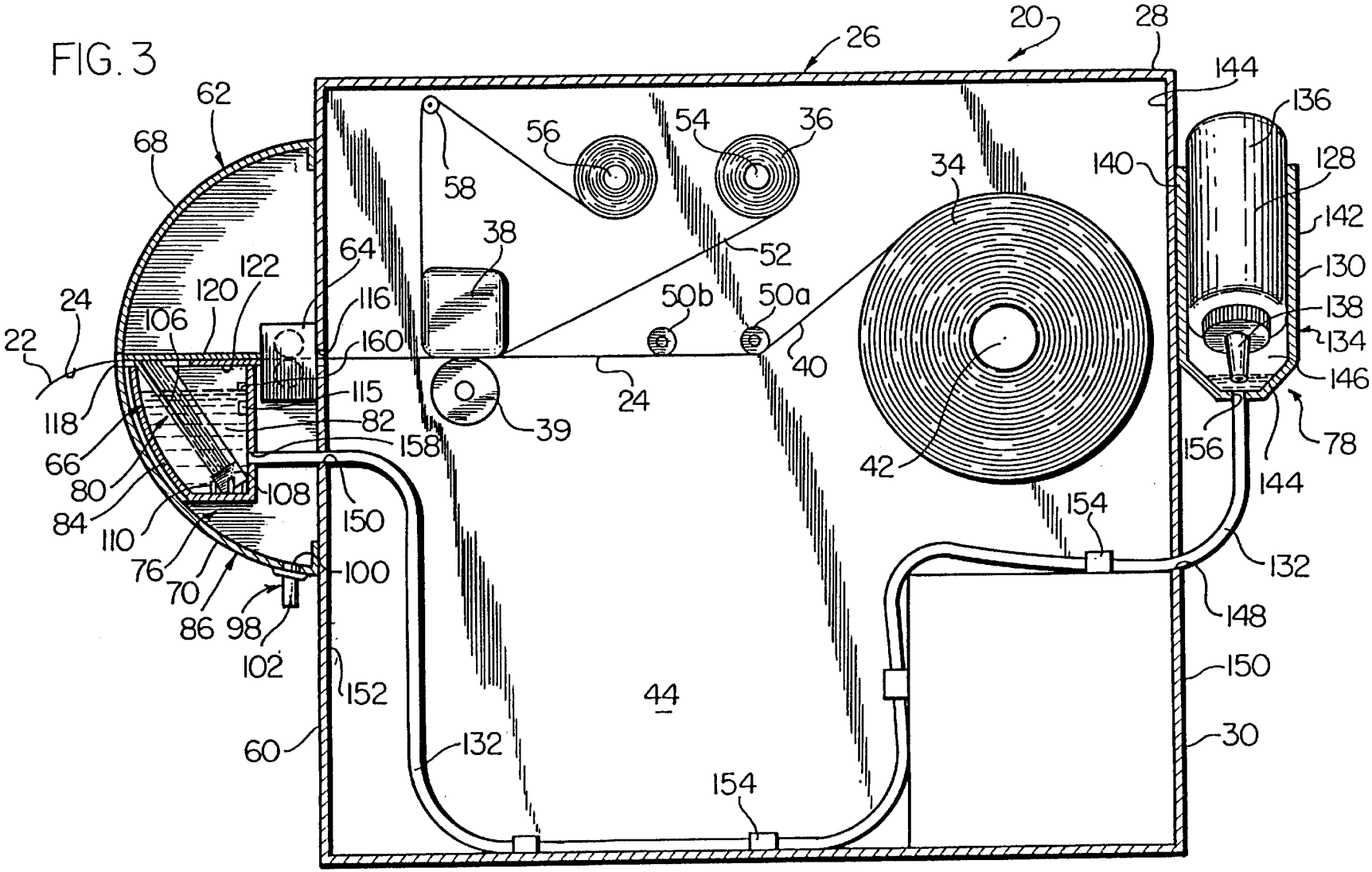
FIG. 3 is a schematic, side elevational view of the interior of the printer apparatus shown in FIG. 1 in accordance with the present invention.

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein.

The present invention presents a novel printer apparatus 20 and method for printing, cutting, moistening or wetting and dispensing a linerless label 22 having a liquid-activated adhesive coating 24. The printer apparatus 20 dispenses the moistened label 22 on demand by an operator so that the moistened label 22 can be taken directly from the printer apparatus 20 and be adhered to the item to be labeled. The printer apparatus 20 is used to print indicia or images, such as bar codes and the like, on the label 22 prior to the label 22 being moistened and dispensed from the printer apparatus 20.

The printer apparatus 20 includes a casing 26 having a cover 28 and a body 30 which form an enclosure. The cover 28 is connected to the body 30 by hinges 32 which allow the cover 28 to be pivoted upwardly relative to the body 30 to provide access to the components housed within the casing 26 so that the printer apparatus 20 can be serviced. The cover 28 and body 30 are formed from a suitable material, such as metal. As shown in FIG. 3, a media supply roll 34, a transfer roll 36 and printhead means 38 and an associated platen roller 39 are mounted within the casing 26.

The media supply roll 34 is formed from a linerless media 40 which has been rolled into a roll. The media supply roll 34 is mounted on a hangar arm 42 which is cantilevered from a central support wall 44 mounted in the casing 26. The linerless media 40 has an upper surface 46 and a lower surface 48. By using the term "linerless" herein, this means that the media 40, and subsequent label 22 produced as described herein, does not employ the use of release paper as is used in the prior art. The upper surface 46 of the media 40 is suited for receiving printed indicia or a printed image, such as a bar code and the like, which is printed thereon by the printhead means 38. The printer apparatus 20 can print all types of graphics, text, and bar codes. The bottom surface 48 of the media 40 has the liquid-activated adhesive coating 24 thereon. The media supply roll 34 is replaceable so that a new roll can be provided in the printer apparatus 20 when the roll 34 is exhausted of media 40.

The media 40 is supplied to the printhead means 38 such that the media 40 passes between the printhead means 38 and the platen roller 39 where the printhead means 38 prints the indicia or image on the media 40. The printhead means 38 and platen roller 39 are each of a known structure. The platen roller 39 is driven by suitable means and is used to drive the media 40 through the printer apparatus 20. Idler rollers 50*a*, 50*b* are provided for directing the media 40 to the printhead means 38 and platen roller 39 from the media supply roll 34.

The transfer roll 36 is formed from a transfer ribbon 52 which has been rolled into a roll. The transfer roll 36 is mounted on a hangar arm 54 which is cantilevered from the central support wall 44. The transfer roll 36 has a transfer take-up roller hangar arm 56 associated therewith for collecting transfer ribbon 52 after it has passed through the printhead means 38. The take-up roller hangar arm 56 is cantilevered from the central support wall 44. The take-up roller hangar arm 56 is powered through a slip clutch, or other suitable means, for collecting the transfer ribbon 52 under a constant tension. The transfer roll 36 is replaceable so that an unused transfer roll can be provided in the printer apparatus after the transfer ribbon 52 has been spent.

In a preferred embodiment, the printing technology used is thermal transfer printing technology, where a transfer ribbon is supplied to the printhead means 38. The transfer ribbon 52 is supplied to the printhead means 38 and comes into contact with the top surface 46 of the media 40 in the printhead means 38. The printhead means 38 is used to transfer ink from the transfer ribbon 52 onto the upper surface 46 of the media 40 in order to form the desired indicia or image on the media 40. An idler roller 58 is provided for directing the spent transfer ribbon 52 to the transfer take-up roller hangar arm 56 where the spent transfer ribbon 52 is collected. It is to be noted that the transfer roll 36 and take-up roller hangar arm 56 can be eliminated and instead, in another embodiment, the printhead means 38 can operate in direct thermal mode to form the desired indicia or image on the media 40. Alternatively, printhead means can be provided to mark the media 40 by dot matrix or by ink-jet.

Connected to a front wall 60 of the printer casing 26 is a forward module 62 which houses a cutter 64 and a liquid application structure 66 for applying liquid to the underside 48 of the media 40 to wet or moisten the underside 48 of the media 40 after the indicia or image has been printed on the upper surface 48 of the media 40 by the printhead means 38. The forward module 62 is formed as a separate component which is attached to the printer casing 26 by suitable means. For example, the forward module 62 can be welded to the front wall 60 of the casing 26 or the casing 26 may have a suitable attachment means thereon for allowing the forward module 62 to be selectively connected to the casing 26 such that the forward module 62 is readily removable from attachment to the casing 26.

The forward module 62 is formed from an upper section 68 and a lower section 70. Each section 68, 70 has an arcuate-shaped front wall 72 and opposite side walls 74*a*, 74*b* which form a three-sided member. The side walls 74*a*, 74*b* are flat and extend from the arcuate-shaped front wall 72 to the front wall of the cover 28 and the body 30, respectively. Other shapes may be used for the walls 72, 74*a*, 74*b*. The open sides of the sections 68, 70 are proximate to each other. A back wall may be provided on each section 68, 70 to form a four-sided member if the application design requires a back wall. Upper section 68 is sealedly attached to the front wall of the cover 28 and lower section 70 is sealedly attached to the front wall of the body 30 of the printer casing 26.

The liquid application structure 66 used in the present invention includes a reservoir 76 which is supplied by a liquid delivery structure 78, described herein, and a moistening brush 80 which is removably mounted in the reservoir 76. Preferably, in the present invention, water is used as the liquid, but it is envisioned that other liquids may be used. Because water is the preferred liquid, the term "water" will be used herein to denote the liquid used in the printer apparatus 20 of the present invention. The reservoir 76 holds a supply of water 82 or the like and in which the brush 80 is partially submerged so that brush 80 can be wetted as described herein.

The reservoir 76 is preferably double-walled, such that the reservoir 76 includes an inner wall 84 and an outer wall 86. As shown, the outer wall 86 is formed by the walls 72, 74*a*, 74*b* of the lower section 70 of the forward module 62. Alternatively, the outer wall 86 of the reservoir 76 may be formed by providing a separate wall within the lower section 70.

The inner wall 84 is formed by a front wall 88, a rear wall 90, opposite side walls 92*a*, 92*b* which connect the front and rear walls 88, 90 together and a bottom wall 94 which connects the front, side and rear walls 88, 90, 92*a*, 92*b* to form a cup-like member. The inner wall 84 holds the supply of water 82 therein. The inner wall 84 is spaced from the outer wall 86 and is mounted in the outer wall 86 by a plurality of spaced, short ribs 96 which connect the front and side walls 88, 92*a*, 92*b* of the inner reservoir wall 84 to the front and side walls 72, 74*a*, 74*b* of the outer reservoir wall 84. Thus, the length of the inner reservoir wall 84 is approximately the same as the lower section 70. The inner wall 84 and the outer wall 86 are in fluid communication.

The outer wall 86 provides an important function in the printer apparatus 20 of the present invention. The Underwriter's Laboratory requires that a printer must be able to be able to be tipped approximately 10° from horizontal without spilling any water or the like. In order to prevent spillage, any water that is spilled from the inner wall 84 when the printer apparatus 20 is tipped is caught in the outer wall 86 of the double-walled reservoir 76.

The reservoir 76 is provided with an overflow drain or gutter system 98 to prevent the reservoir 76 from becoming excessively full and overflowing if too much water is spilled into the outer wall 86 from the inner wall 84 because of the printer apparatus 20 being tipped. The overflow drain 98 is provided for by an opening 100 through the bottom of the front wall 72 of the outer wall 86 and a tube 102 which is sealed and attached to the opening 100 by suitable means. The tube 102 extends from the opening 100 downwardly to a disposal means (not shown).

The reservoir 76 is preferably recirculating so as to keep a fresh supply of water to the moistening brush 80. The recirculation of the water in the reservoir 76 diminishes bacterial or fungal growths from occurring in the water. The reservoir 76 may have an active or passive supply pump. In addition, the reservoir 76 is properly sized to prevent excessive evaporation of the water from the reservoir 76.

The reservoir 76 is refillable by the liquid delivery structure 78, as described herein, and is adapted to keep the water level on the moistening brush 80 constant. The reservoir 76 is preferably translucent so that the operator can easily see the water level in the reservoir 76.

Another feature of the reservoir 76 is that baffles 104 are provided therein to minimize sloshing of the water 82 in the inner wall 84 of the reservoir 76. The baffles 104 are provided for by a plurality of intermediate walls which extend perpendicular to the length of the reservoir 76. The intermediate walls have openings therethrough so as to provide for fluid communication through the baffle walls 104. In addition, the baffles 104 have slots therein for receiving the moistening brush 80.

In the preferred embodiment, the moistening brush 80 is used to completely moisten or wet the adhesive coating 24 on the underside 48 of the media 40 by contacting the underside 48 of the media 40 so as to apply water to the adhesive coated surface 48. The brush 80 moistens the adhesive coating 24 on the underside 48 of the media 40 uniformly and sufficiently so that the moistened label 22 that is produced by the printer apparatus 20 can be taken out of the printer apparatus 20 and immediately be adhered to an item which is to be labeled. The brush 80 does not wet the media 40 so much that the water drips or gets into the printer apparatus 20. It is to be understood that other wetting structures, such as porcelain rollers, aluminum smoothed and grooved rollers, and cloth covered rollers, or a sprayer, are within the scope of the invention.

The brush 80 is formed from a plurality of individual bristles 106 which are closely held together by a base 108. The brush bristles 106 are made of suitable material, preferably horsehair or polyester, nylon or goat hair, and is commercially available. The brush 80 can be purchased with different types of bristles 106 and lengths.

The moistening brush 80 is mounted in the inner wall 84 of the reservoir 76 by a support 110 such that the brush 80 is held securely therein and is also removable from the support 110. When mounted in the support 110, the bristles 106 of the brush 80 are partially submerged in the water 82 in the inner reservoir wall 84 and partially exposed so as to not be submerged in the water 82. The water 82 is transferred from the reservoir 76 through the brush 80 and onto the underside 48 of the media 40. The water 84 is conveyed along the brush bristles 106 by a capillary action. The capillary action is incorporated into the individual bristles 106 or formed by tight packing of multiple bristles 106 in the brush 80.

The brush 80 can be removed from the reservoir 76 and replaced with a new brush. This removable mounting allows an operator to replace the brush 80 after a predetermined number of uses or when the brush 80 becomes otherwise worn from repetitive use.

As clearly shown in FIG. 4, the brush 80 is mounted in the reservoir 76 such that the bristles 106 are offset at a predetermined angle, approximately 45°, relative to a vertical axis. An upper portion 111 of the front wall 88 of the inner reservoir wall 84 forms a brush support for an upper portion 112 of the brush 80 such that the bristles 106 rest against the brush support 111. The bristle top ends 114 are cut at an angle, approximately 45°, relative to a vertical axis so that the media 40 easily rides or glides over the brush 80. Because the brush 80 is angled in the reservoir 76 and the top ends of the brush bristles 106 are cut at a 45° angle, the media 40 movement will not be stopped by the brush 80 which could cause the media 40 to buckle. If the brush 80 and brush angle were vertical, the media 40 would stop moving upon contact with the brush 80 causing an undesired jam in the printer apparatus 20.

The slanting and angle cut of the bristles 106 provide two important functions. First, a greater surface with which to wet or moisten the adhesive coating 24 on the underside 48 of the media 40 is provided so that the media 40 is moistened or wetted uniformly and completely. Second, the angled brush 80 provides less resistance than a brush 80 that has bristles that are vertical so as to minimize buckling of the media 40 as it passes thereover and to allow the media 40 to easily glide over the brush 80.

As shown in FIG. 5, the brush 80 extends along the length of the inner reservoir wall 84. The brush support 111 eliminates deflection of the brush bristles 106 as the media 40 is moved thereover. The effect is threefold. First, this enhances the water application to the underside 48 of the media 40. Second, this reduces the amount of priming necessary to render the printer apparatus 20 usable after long idle periods. Third, it allows the water level to be higher or closer to the tip 114 of the moistening brush 80, which improves the amount of time needed to prime and also improves the water application to the underside 48 of the label 22.

In addition, a heater 115, which is powered by suitable means, is provided on the moistening brush 80 or mounted in the water on the reservoir wall 84. The heater 115 improves the wetting and the set-up time of the adhesive on the underside 48 of the label 22.

The cutter 64 is preferably positioned within the forward module 62, but may be positioned within the printer casing 26 if desired, and is attached thereto by suitable means. The cutter 64 is formed by at least one blade which is used to sever the media 40 into individual sections or labels 22. The cutter 64 is positioned a predetermined distance from the printhead means 38 and is placed before the moistening or wetting stage, which is provided by the reservoir 76 and moistening brush 80, to avoid the collection of adhesive on the cutter blades by the moistened adhesive, which is undesirable. In addition, the cutter 64 is positioned adjacent to an elongated slot 116 formed in the front wall 60 of the printer casing 26 between the cover 28 and the body 30 so that the cutter 64 can receive the printed-on media 40 as it leaves the printhead means 38.

As also shown in FIGS. 3, 4 and 5, as the printed label 22 is moved from the cutter 64 to a front exit slot 118 provided at the juncture between the upper and lower sections 68, 70 of the forward module 62, the label 22 is guided by an upper guide plate 120 and a lower guide plate 122 over the moistening brush 80. The guide plate 120 is adapted for forcing the label 22 down onto the moistening brush 80 or other provided wetting apparatus.

The guide plates 120, 122 are elongated and generally flat such that each guide plate 120, 122 generally extends from one side wall 74*a* to the opposite side wall 74*b* of the forward module 62. The upper guide plate 120 extends from generally the cutter 64 to the front exit slot 118. The lower guide plate 122 extends from generally the cutter 64 to the top of the brush 80. The ends 124, 126 of the guide plates 120, 122 which are proximate to the cutter 64 are bent outwardly from each other to allow the media 40 to easily enter between the guide plates 120, 122 from the cutter 64. The bottom guide plate 122 starts the label 22 on the moistening brush 80 so that the label 22 does not hit the brush bristles 106 and abruptly stop. The top guide plate 120 keeps the label 22 from buckling as it passes over the moistening brush 80.

The elongated guide plates 120, 122 serve three important functions in the printer apparatus 20. First, the guide plates 120, 122 aim the label 22 properly over the brush 80 so that the label 22 will be properly wetted or moistened. Second, the guide plates 120, 122 provide the label 22 with some rigidity so as to ensure complete contact of the label 22 with the brush 80. Third, the guide plates 120, 122 hold a portion of the moistened label 22 in the printer apparatus 20 until the operator can take the label 22 from the printer apparatus 20. If necessary, an adjustable weight may be provided on top of the upper guide plate 120 to further force the label 22 down onto the brush 80. The guide plates 120, 122 may incorporate motorized wheels for forcing small labels out of the printer apparatus 20.

As shown in FIGS. 2 and 3, the liquid delivery structure 78 includes a container 128, such as a bottle or the like, which is housed in a feeder 130, and a length of polyethylene tubing 132 which extends between the feeder 130 and the double-walled reservoir 76. The feeder 130 and container 128 form a rearward module 134 which is attached to the printer casing 126. FIG. 2 shows the rearward module 134 before it is attached to a rear wall of the printer casing 26 and FIG. 3 shows the rearward module 134 after it is attached to a rear wall of the printer casing 26. The rearward module 134 is mounted on the printer casing 26 by suitable means, such as welding or by other suitable attachment means, as described herein.

The container 128 is formed from a body 136 having an open spigot or nozzle 138 at one end. The container 128 holds a supply of water, or other liquid, which is supplied to the reservoir 76 through the length of tubing 132.

The feeder 130 is formed from a trough-like member having a front wall 140, a rear wall 142, a side wall 144 and a bottom wall 146. The side and bottom walls 144, 146 connect the front and rear walls 140, 142 of the feeder 130 together. An opposite side wall may be provided. The front wall 140 of the feeder 130 is connected to a rear wall of the cover 28 by suitable means, such as by welding or other suitable attachment means. The feeder 130 is positioned at an angle relative to the printer casing 26 such that the feeder 130 is offset from the horizontal so that the container 128 housed therein is angled. This will cause the water in the container 128 to flow out of the container 128 while allowing air to enter into the container 128 and replace the water.

The container 128 may be removed from the feeder 130 so that the container 128 can be refilled with a fresh supply of water or so that a new container can be placed in the feeder 130. When the container 128 is placed in the feeder 130, the open nozzle 138 is positioned adjacent to the lowermost portion of the feeder 130.

The tubing 132 preferably passes through the printer casing 26 by entering through an aperture 148 in a rear wall 150 of the body 30 and exiting through an aperture 150 in a front wall 152 of the body 30 and into the forward module 62. The tubing 132 is mounted to the inside of the casing 26 by hose mounting clips 154. The tubing 132 is sealedly connected at one end to the feeder 130 through an opening 156 in the lowermost portion of the feeder 130. The other end of the tubing 132 is sealedly connected to the reservoir 76 through an opening 158 in the rear wall 90 of the inner reservoir wall 84 such that water from the container 128 is solely fed into the inner reservoir wall 84. The polyethylene tube 132 is of a large diameter to prevent air spaces in the tube 132. In addition, a water softener may be added to the water to reduce air bubbles in the tubing 132. By having the tubing 132 pass through the printer apparatus 20, the tubing 132 is substantially protected from damage because it is not exposed. Alternatively, however, the tubing 132 may be provided along the exterior of the casing 26 and attached thereto by suitable means.

The liquid delivery structure 78 works by gravity feed by having the bottom end of the nozzle 138 being at the same height level as the desired water level in the inner reservoir wall 84. This keeps the water level in the inner reservoir wall 84 at a predetermined level.

When the container 128 is placed in the feeder 130, the water in the container 128 will freely flow out and fill the inner reservoir wall 84 and the tubing 132. The water from the container 128 will continue to freely flow out of the container 128 until the water backs up into the feeder 130 and covers the nozzle 138. Thereafter, water will only flow out of the container 128 when the water level in the feeder 130 drops enough to uncover the nozzle 138, which will then allow more water to flow out of the container 128. As the water level drops in the inner reservoir wall 84 due to the capillary action of the water 82 onto the underside 48 of the media 40 by the brush 80, the water level in the feeder 130 drops which forces air through the nozzle 138 and into the container 128. The air then displaces additional water from the container 128 into the feeder 130 which subsequently flows into the inner reservoir wall 84. This maintains a constant water level at the brush reservoir 76 no matter how much water is in the container 128. The container 128 can be run dry since water will remain in the tube 132 until the container 128 is replenished with water or replaced with a new, full container.

In order to determine when the container 128 is empty, the level of water is sensed by a sensor 160. The sensor 160 can be placed at the container 128, along the length of tubing 132 or at the inner reservoir wall 84 to sense the water level. An optical sensor, or other suitable sensing means, is used as the sensor. If an optical sensor is used, color is added to the water 82 to enable the optical sensor to rapidly sense the water level. The water 82 can be colored by using a pill additive which, in addition to adding color to the water 82, can also provide anti-bacterial and anti-fungal solutions to the water 82.

The printer apparatus 20 is driven by a microprocessor and suitable electronic circuitry (not shown) which causes motors and drivers to operate the platen roller 39 to move the media 40 and transfer ribbon 52, if one is used, through the printer apparatus 20 and to print on the media 40 using the printhead means 38, and the cutter 64 to operate. In addition, suitable electronic circuitry is connected to the printhead means 38 to signal the printhead means 38 as to what indicia or image is to be printed on the media 38. The printer apparatus 20 can be wall powered or portable and battery powered.

Directing attention to FIG. 1, the forward module 62 includes a label-request or demand button 162 on a front panel. The demand button 162 must be pushed or depressed by an operator to dispense a moistened or wetted label 22 from the printer apparatus 20. After the label 22 is moistened, the operator takes the label 22 from the printer apparatus and directly applies the moistened label 22 to the item to be labeled. The printer apparatus 20 of the present invention prints the moistened label 22 quickly so that the operator does not have to wait an excessive amount of time for the label 22 to be printed and dispensed from the printer apparatus 20.

The printer apparatus 20 does not initiate a print sequence until a demand switch within the printer apparatus electronics is activated by the operator depressing the demand button 162. This allows the label 22 to begin printing only when requested, thereby preventing pre-printing of the label 22 and premature drying of the moistened or wetted adhesive coating 24.

If desired in the application, the demand button 162 can be activated by an external device, such as an applicator engine or a microprocessor. For example, a conveyor device which transfers the wetted label 22 to the item to be labeled may be used. The conveyor device activates the demand button 162 automatically when it senses that a label 22 is needed.

Now that the specifics of the printer apparatus 20 have been described, the method of using the printer apparatus 20 to print a moistened label 22 will be described.

First, the operator depresses the demand button 162 which signals the printer apparatus 20 to print and form the individual label 22. The electronic circuitry signals the platen roller 39 to move the media 40 and the transfer ribbon 52, if a transfer ribbon 52 is provided in the application, to the printhead means 38. The printhead means 38 prints the desired indicia or image on the upper surface 46 of the media 40.

The printed media 40 is then moved to the cutter 64 by the platen roller 39 and between the guide plates 120, 122 and over the moistening brush 80. After the desired amount of label length has passed by the cutter 64, the cutter 64 severs the media 40 to form the individual label 22. As the label 22 is moved over the brush 80, the bristles 106 uniformly and completely wet or moisten the adhesive coating 24 on the underside 48 of the individual label 22 because of the contact of the bristles 106 with the underside of the label 22. Thereafter, a portion of the label 22 protrudes outwardly from the front of the printer apparatus 20 through the forward slot 118 in the printer casing 26, while a portion of the moistened label 22 is held by the guide plates 120, 122 in the printer apparatus 20. The operator removes the pre-moistened label 22 and adheres it to the item to be labeled. The procedure is repeated for each label 22 that is needed.

The present invention presents several other advantages. The printer apparatus 20 can be manufactured at a low cost. In addition, the printer apparatus 20 is easy to use.

The printer apparatus 20 can be adjusted for adjusting the length of the printed label 22 so the label 22 is usable for a variety of applications by providing a cutter which will sever the media 40 at a different length. The printer apparatus 20 and all internal components are rotatable so that the printer apparatus 20 can operate in multiple orientations.

Because the forward and rearward modules 62, 134 are modular, the modules 62, 134 and tubing 132 can be easily added to an existing thermal-type printer. It is adaptable for print and apply systems and various print engines. In addition, the modules 62, 134 are upgradable. For example, a larger reservoir may be substituted for the one that is currently being used. Additionally, the forward and rearward modules 62, 134 could be eliminated, and instead, all components could be housed in the casing 26.

Other features may be included in the design of the printer apparatus 20. For example, the media supply roll 36 can be external or internal. The media supply roll 36 can be adapted for accepting shipping tape with address labels thereon for sealing cartons. In addition, a fan fold feed could be used for supplying the media 40 to the printhead means 38.

The water delivery structure 78 could also take several forms. For example, a refillable external or internal tray could be provided.

While a preferred embodiment of the present invention is shown and described, it is envisioned that those skilled in the art may devise various modifications of the present invention without departing from the spirit and scope of the appended claims.

The invention claimed is:

1. A printer apparatus for producing a pre-moistened label, said printer apparatus having a media associated therewith, said media having an upper surface and a lower surface, said lower surface having a liquid activated adhesive thereon, said printer apparatus comprising: an outer casing; printhead means mounted in said casing for printing indicia on said upper surface of said media; liquid application means associated with said casing for applying liquid to said adhesive coated lower surface of said media to pre-moisten said media after said printhead means has printed the indicia on said upper surface of said media; liquid delivery means associated with said casing for supplying liquid to said liquid application means and a reservoir comprising an inner wall and an outer wall, said inner wall being spaced from and generally surrounded by said outer wall, said inner wall having said liquid application means positioned therein and holding liquid therein, said outer wall retaining any spillage of liquid from said inner wall.

2. A printer apparatus as defined in claim 1, wherein said liquid application means is a brush removably mounted in said inner wall.

3. A printer apparatus as defined in claim 2, wherein said brush has bristles and is positioned within said inner wall such that said bristles are offset from a vertical axis.

4. A printer apparatus as defined in claim 3, wherein an upper portion of said brush bristles rest against an upper portion of said inner wall.

5. A printer apparatus as defined in claim 3, wherein each bristle has a top end and said top ends are cut at an angle so as to allow the media to glide over the bristles.

6. A printer apparatus as defined in claim 3, further including mounting structure for mounting said brush in said inner wall of said reservoir wherein said brush is removably mounted in said inner wall of said reservoir by said mounting structure.

7. A printer apparatus as defined in claim 3, further including guide means for guiding said media over said brush.

8. A printer apparatus as defined in claim 7, wherein said guide means comprises a top elongated guide plate and a bottom elongated guide plate, said media passing between said elongated guide plates, said top elongated guide plate causing said media to maintain contact with said brush.

9. A printer apparatus as defined in claim 3, further including cutting means for severing said media to provide an individual label, said cutting means forming said individual label by cutting an unmoistened portion of said individual label prior to the application of liquid to all of said adhesive coated lower surface of said media by said brush.

10. A printer apparatus as defined in claim 3, further including a heater associated with said brush.

11. A printer apparatus as defined in claim 1, further including baffles in said inner wall of said reservoir to minimize sloshing of said liquid in said inner wall.

12. A printer apparatus as defined in claim 1, further including an overflow drain connected to said outer wall for venting any liquid therein to the exterior of the printer apparatus.

13. A printer apparatus for producing a pre-moistened label, said printer apparatus having a media associated therewith, said media having an upper surface and a lower surface, said lower surface having a liquid activated adhesive thereon, said printer apparatus comprising:

an outer casing;

printhead means mounted in said casing for printing indicia on said upper surface of said media;

liquid application means associated with said casing for applying liquid to said adhesive coated lower surface of said media to pre-moisten said media after said printhead means has printed the indicia on said upper surface of said media;

liquid delivery means associated with said casing for supplying liquid to said liquid application means and comprising a containing structure for holding liquid therein and connected to said casing, a reservoir for holding said liquid therein, said liquid application means being positioned in said reservoir, connecting means for connecting the containing structure to said liquid application means and being connected to said reservoir, said reservoir comprises an inner wall and an outer wall, said inner wall being positioned in and spaced from said outer wall, said connecting means being connected to said inner wall to provide liquid from said container to said inner wall, said outer wall retaining any spillage of liquid from said inner wall; and demand means comprising a demand button associated with said printer apparatus which is activated by an operator to cause said printer apparatus to form and dispense a moistened, printed label on demand by an operator, said printer apparatus printing and forming a moistened, printed label only after said demand button has been activated, wherein the operator must repeatedly activate the demand button to dispense a moistened, printed label.

14. Attachments to a printer apparatus which is used to print indicia on a media associated with said printer apparatus, said printer apparatus including a casing for housing various components, a printhead means for printing indicia on an upper surface of said media, said attachments comprising: a first module connected to an outer surface of said printer apparatus casing, said first module comprising liquid application means for applying liquid to an adhesive coated lower surface of said media to pre-moisten said media and a reservoir comprising an inner wall and an outer wall, said inner wall being spaced from and generally surrounded by said outer wall, said inner wall having said liquid application means positioned therein and holding liquid therein, said outer wall retaining any spillage of liquid from said inner wall, a second module connected to an outer surface of said printer apparatus, said second module comprising liquid delivery means for supplying liquid to said liquid application means in said first module; and connecting means connected to said casing for connecting said first module and said second module together, said printhead means in said printer apparatus printing indicia on said upper surface of said media prior to said adhesive coating on said lower surface of said media being moistened by said liquid application means in said first module.

15. Attachments as defined in claim 14, said first module further including cutting means for severing said media to provide an individual label, said cutting means forming said individual label by cutting an unmoistened portion of said individual label prior to the application of liquid to all of said adhesive coated lower surface of said media by said liquid application means.

16. Attachments as defined in claim 14, said first module further including guide means for guiding said media over said liquid application means.

17. Attachments as defined in claim 14, wherein said liquid application means in said first module comprises a brush having a plurality of individual bristles.

18. Attachments as defined in claim 17, wherein said brush is positioned within said reservoir for transporting liquid to moisten said media by a capillary action.

19. Attachments as defined in claim 14, wherein said liquid delivery means in said second module comprises a containing structure for holding liquid therein.

* * * * *